US008468622B2

(12) United States Patent
Purwar et al.

(10) Patent No.: US 8,468,622 B2
(45) Date of Patent: Jun. 25, 2013

(54) PORTABLE SIX-BAR APPARATUS FOR LIFTING, LOWERING AND SELF-PROPELLED TRANSIT

(75) Inventors: Anurag Purwar, Stony Brook, NY (US); Thomas Galeotafiore, Port Jefferson Station, NY (US); Justin Miles, Queensbury, NY (US); Jeffrey Renert, Cold Spring Harbor, NY (US)

(73) Assignee: The Research Foundation of State University of New York, Albany, NY (US)

( * ) Notice: Subject to any disclaimer, the term of this patent is extended or adjusted under 35 U.S.C. 154(b) by 343 days.

(21) Appl. No.: 12/868,446

(22) Filed: Aug. 25, 2010

(65) Prior Publication Data

US 2012/0047648 A1 Mar. 1, 2012

(51) Int. Cl.
*A61G 7/10* (2006.01)

(52) U.S. Cl.
USPC ..... 5/86.1; 5/83.1; 297/5; 482/97

(58) Field of Classification Search
USPC ..... 5/81.1 R, 83.1, 85.1, 86.1, 87.1, 5/662; 135/65, 66, 67, 71, 74, 85, 912; 280/87.021, 87.03, 87.041, 87.05; 482/95, 482/97
See application file for complete search history.

(56) References Cited

U.S. PATENT DOCUMENTS

| | | | | | |
|---|---|---|---|---|---|
| 120,064 | A * | 10/1871 | Haupt | 297/61 |
| 3,145,999 | A * | 8/1964 | Burnham | 280/648 |
| 3,629,880 | A * | 12/1971 | van Rhyn | 5/83.1 |
| 4,809,804 | A * | 3/1989 | Houston et al. | 180/65.51 |
| 4,917,379 | A * | 4/1990 | Maag | 482/97 |
| 5,001,789 | A * | 3/1991 | Schoenberger | 5/87.1 |
| 5,333,887 | A * | 8/1994 | Luther | 280/250.1 |
| 5,507,710 | A * | 4/1996 | Chen | 482/72 |
| 5,527,250 | A * | 6/1996 | Chen | 482/96 |
| 5,676,626 | A * | 10/1997 | Huang | 482/96 |
| 5,785,070 | A | 7/1998 | Block et al. | |
| 6,315,319 | B1 * | 11/2001 | Hanson et al. | 280/650 |
| 6,343,802 | B1 * | 2/2002 | Workman et al. | 280/87.041 |
| 6,503,176 | B2 * | 1/2003 | Kuntz | 482/66 |
| 6,733,018 | B2 | 5/2004 | Razon | |
| 7,363,931 | B2 | 4/2008 | Weaver | |
| 7,377,285 | B2 | 5/2008 | Karasin | |
| 7,568,712 | B2 * | 8/2009 | Kovachi et al. | 280/87.021 |
| 2005/0020416 | A1 * | 1/2005 | Leipheimer | 482/97 |
| 2005/0285428 | A1 * | 12/2005 | Dilluvio | 296/107.08 |
| 2006/0096626 | A1 | 5/2006 | Weaver | |
| 2010/0287698 | A1 * | 11/2010 | Stryker | 5/87.1 |

OTHER PUBLICATIONS

Sharon Nuzik et al., Sit-to-Stand Movement Pattern, Physical Therapy, vol. 66, No. 11, Nov. 1986, pp. 1708-1713.
EasyStand StrapStand Wheel Up and Stand, http://www.easystand.com/strapstand, StrapStand 2011 Catalog pp. 12-14.
EasyStand Glider Active Standing, Be Ready, http://www.easystand.com/glider, Glider 2011 Catalog pp. 9-11.
The Original Lift Walker, Prime Engineering, ( c ) 2009 http://www.primeengineering.com/pages/products/liftWalker.html.

* cited by examiner

*Primary Examiner* — Michael Trettel
*Assistant Examiner* — Myles Throop
(74) *Attorney, Agent, or Firm* — The Farrell Law Firm, P.C.

(57) ABSTRACT

Disclosed herein is a portable lifting apparatus that includes an actuator and a lifting mechanism, which includes a parallel bar, a first coupler, a second coupler, a first rocker, a second rocker, and a frame that are each rotatably connected, so that operation of the actuator moves the parallel bar in a J-shaped path while maintaining a constant orientation of the parallel bar.

11 Claims, 8 Drawing Sheets

PORTABLE SIX-BAR APPARATUS FOR LIFTING, LOWERING AND SELF-PROPELLED TRANSIT

GOVERNMENT SUPPORT

This invention was made with government support under grant number CBET0853672 awarded by the National Science Foundation. The government has certain rights in the invention.

BACKGROUND OF THE INVENTION

1. Field of the Invention

This invention relates generally to an apparatus for lifting, lowering, and self-propelled transit of a person having limited use of their legs.

2. Description of Related Art

Many people require assistance moving between standing and seated positions. To reduce dependence on others, numerous devices have been developed, particularly in regard to performing everyday activities.

A conventional device for the transit of partially incapacitated persons includes U.S. Pat. No. 5,785,070, entitled Dual Handle Walking and Uprisal Assist Device, to Block et al., the contents of which are incorporated herein by reference. Block et al. provides an apparatus having a first set of handles used to assist the person when in a standing position and a second set of handles provided in a position beneath the first set of handles. The second set of handles are used to push against when the user wants to rise into a standing position. However, the apparatus of Block et al. requires use of a person's own strength to achieve the standing position, and creates an awkward sitting scenario wherein the user has to lean backward, shift weight onto the second set of handles, which may be behind and beneath the user, and then bend their knees to complete the sitting motion.

Another conventional device is described in U.S. Pat. No. 6,503,176 to Kuntz, entitled Walker Device with Power Assisted Lift, the contents of which are incorporated herein by reference. Kuntz provides a device having a compressed air assembly and a support sling to lift the user from a seated position. The device of Kuntz does not require use of upper body strength to achieve a standing position. However, the device requires use of a compressed air cylinder for power, which is inconvenient to a user due to the weight, cost and impracticality of having to transport and refill compressed air tanks. An additional limitation of Kuntz and other conventional devices is that a user is lifted along a path that differs from a natural standing motion. The unnatural lift motion makes conventional device uncomfortable to use and reduces stability.

Yet another conventional device is described in U.S. Pat. No. 6,733,018 to Razon, entitled Adjustable Leg Support and Seated to Stand Up Walker, the contents of which are incorporated herein by reference. Razon provides a stand up walker for supporting the body weight in a standing position. In Razon, a pair of upper lift arms is mounted on a walker frame with a lift spring, which lifts a user. However, the lifting motion provided by the device of Razon is unnatural, inefficient, and generally painful if the point of application of lifting force is at the armpits. While being lifted from the hips using a sling, ensuring the stability of the device is a major challenge since the center of gravity of the person being lifted is usually outside the footprint of the device. Also, for gas springs to effectively operate, exertion of a user's own strength is required during the lifting phase, to ensure that the gas springs compress during the sitting phase. In addition, gas springs generally do not provide a smooth motion.

Conventional devices fail to provide a user with a stable lifting apparatus that can be repeatedly used without fatigue. Conventional devices also fail to lift a user from a link that moves along a natural path and remains uniformly oriented throughout the lifting process.

To overcome shortcomings of conventional devices, the present invention provides a six-bar lifting apparatus that lifts a person along a natural path and maintains a constant orientation, i.e. a parallel motion, of the link of the apparatus that lifts the user. The constant orientation refers to an orientation that remains uniform and unchanged in relation to a frame of the apparatus and the user. The apparatus can support the user's weight at the buttocks and the armpit region while maintaining stability throughout the entire range of motion. The user of the apparatus of the present invention can also utilize a sling thereof as a seat when used as a walker.

The present invention provides lifting/lowering assistance between seated/standing positions, and also functions as a standard walker and/or gait trainer. Conventional devices do not provide this dual functionality.

SUMMARY OF THE INVENTION

To overcome the deficiencies of conventional devices, the present invention provides in a preferred embodiment a portable lifting apparatus that includes an actuator and a lifting mechanism, which includes a parallel bar, a first coupler, a second coupler, a first rocker, a second rocker, and a frame that are each rotatably connected, so that operation of the actuator moves the parallel bar in a J-shaped path while maintaining a constant orientation of the parallel bar.

In another embodiment, a portable lifting apparatus is provided that includes a frame with first and second parallel lifting mechanisms affixed to the frame having a free space therebetween. An actuator and wheels affixed to an underside of the frame are also provided, allowing the apparatus to assist a user between seated and standing positions, while also assisting the user when in the standing position to propel both the user and the apparatus without bearing the user's entire weight on the either foot by swinging a foot through the free space.

In a further embodiment, a method of lifting a user of a portable lifting apparatus is provided that includes sitting a user on a chair, positioning the chair in a partial free space between a first and second lifting mechanisms of the apparatus that are each affixed to opposite sides of a frame of the apparatus, operating an actuator that equally assists the user between seated and standing positions, and providing a harness or sling as a seat for use in the events the user tires while using the apparatus as a walker or arrest the accidental fall of the user while being lifted or lowered.

BRIEF DESCRIPTION OF THE DRAWINGS

For a better understanding of the invention, as well as other objects and further features thereof, reference is made to the following detailed description to be read in conjunction with the accompanying drawings, wherein.

DESCRIPTION OF THE PREFERRED EMBODIMENTS

The following detailed description of preferred embodiments of the invention is made with reference to the accompanying drawings. In describing the invention, explanation of related functions or constructions known in the art is omitted for the sake of clarity in understanding the concept of the invention and to avoid obscuring the description of the invention with unnecessary details.

Figure 4:
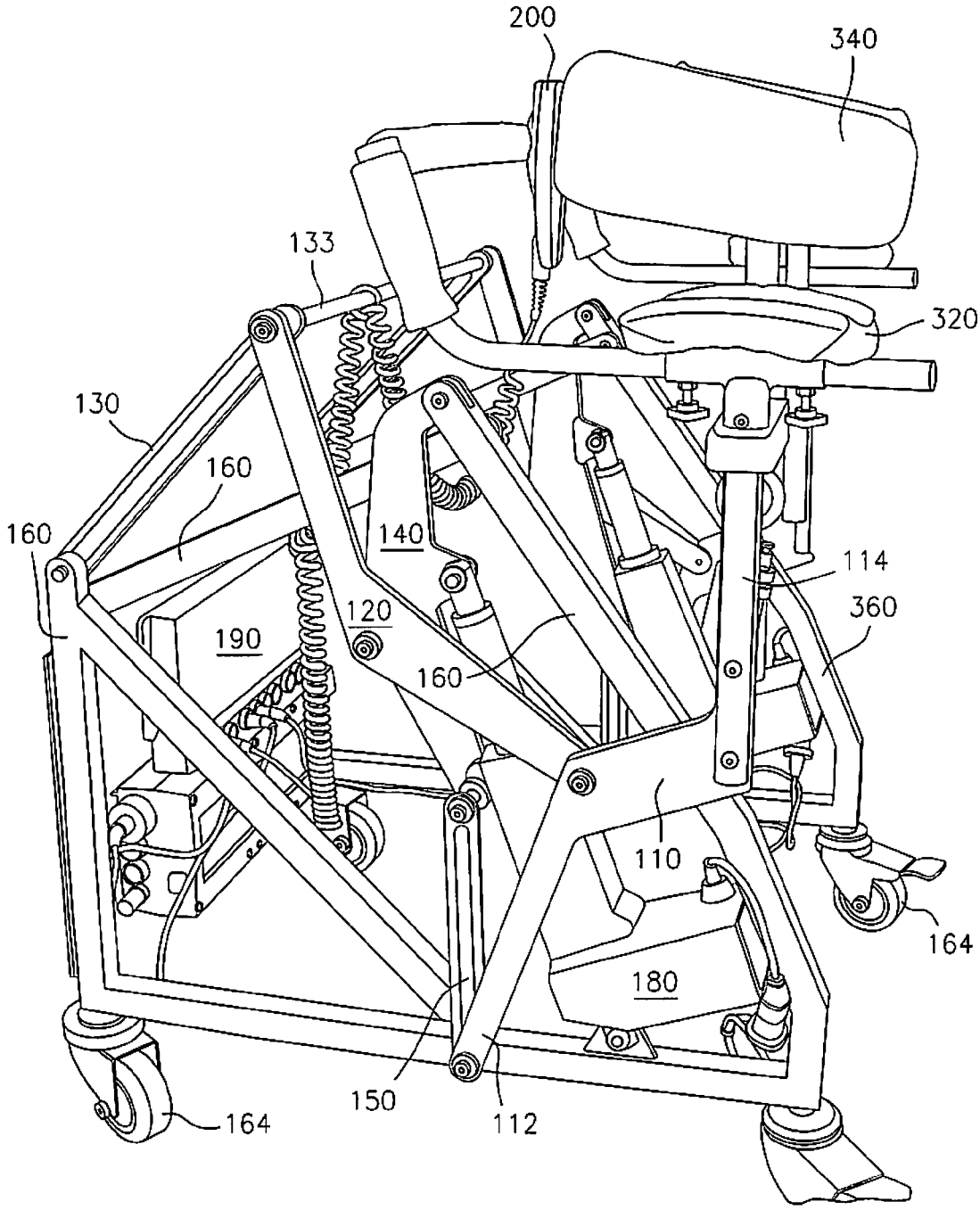
FIG. 4 is a side perspective view of the apparatus of FIG. 1, with the six bar mechanism in a retracted mode.
Figure 5:
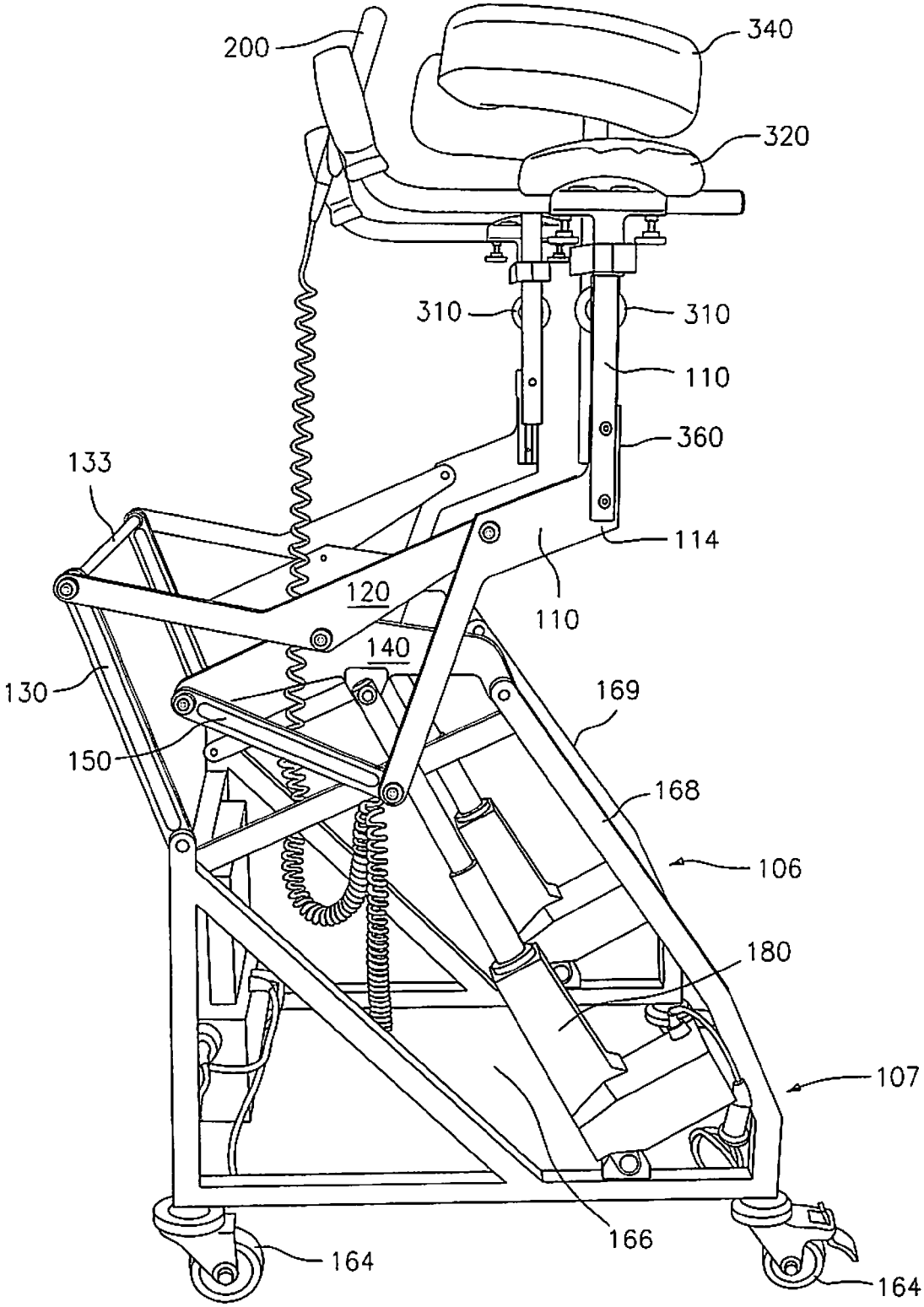
FIG. 5 is a side perspective view of the apparatus of FIG. 1, with the six bar mechanism in an extended mode.

In a preferred embodiment, six interconnected bars form a lift mechanism 105 that provides a J-shaped path for parallel lift that replicates a natural standing motion, as described below and shown in FIG. 8. In the preferred embodiments, a user is lifted via connection to or support by a parallel bar 110, with forearm and underarm crutches (320, 340), and height adjustment 360 (See FIG. 5), provided to assist lifting and balance. Notably, orientation of the parallel bar 110 remains unchanged throughout the lifting process. Compare the position and orientation of parallel bar 110 in FIG. 4, showing the six bar lift mechanism in a retracted mode, to the position of parallel bar 110 in FIG. 5, showing the six bar lift mechanism 105 in an extended mode.

As shown in FIGS. 1-6, the six bars of the lift mechanism 105 are the parallel bar 110, a first coupler 120, a first rocker 130, a second rocker 140, a second coupler 150 and the frame 160.

Figure 1:
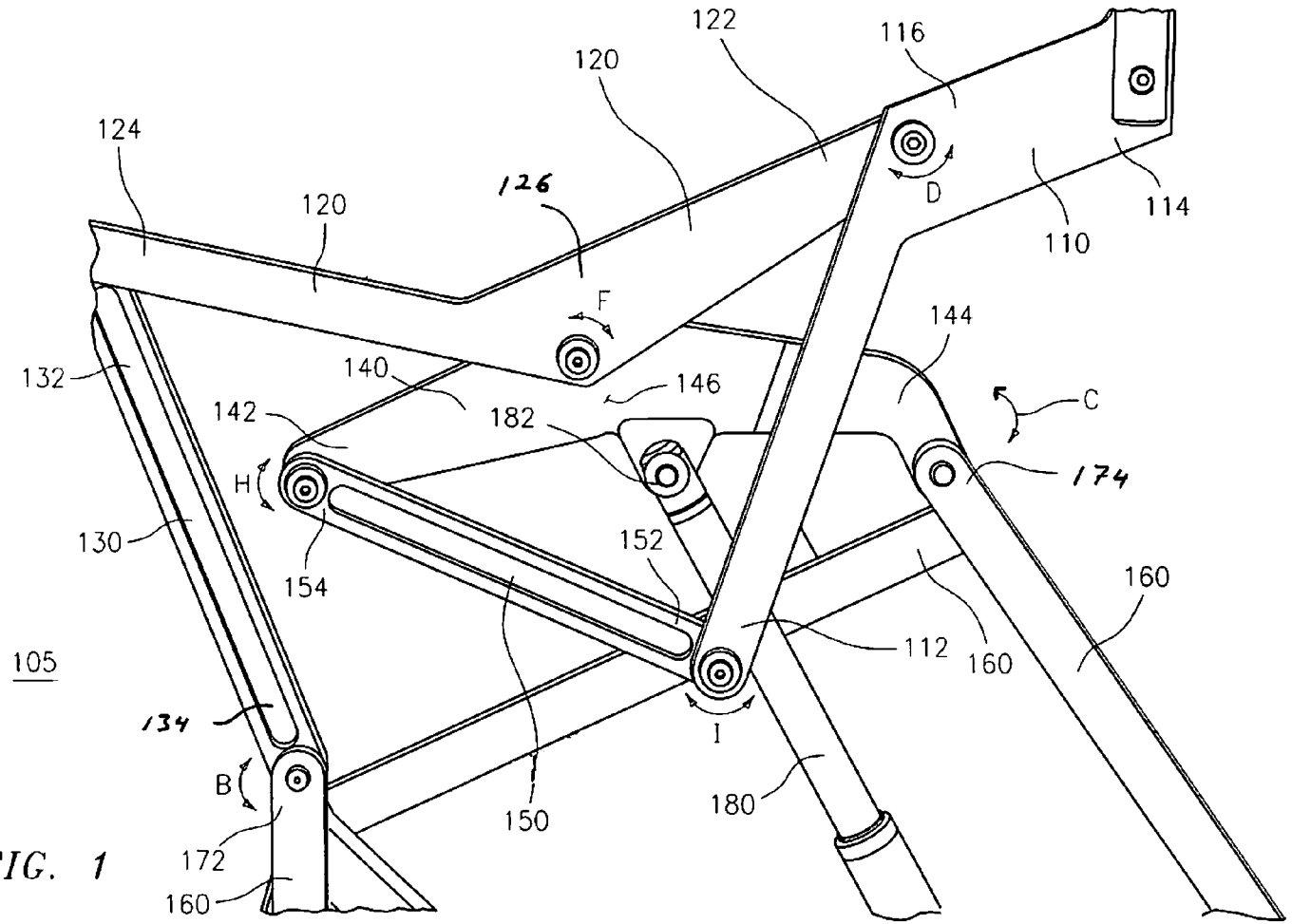
FIG. 1 is a profile view of a parallel six bar lifting mechanism of an embodiment of the present invention.
Figure 2:
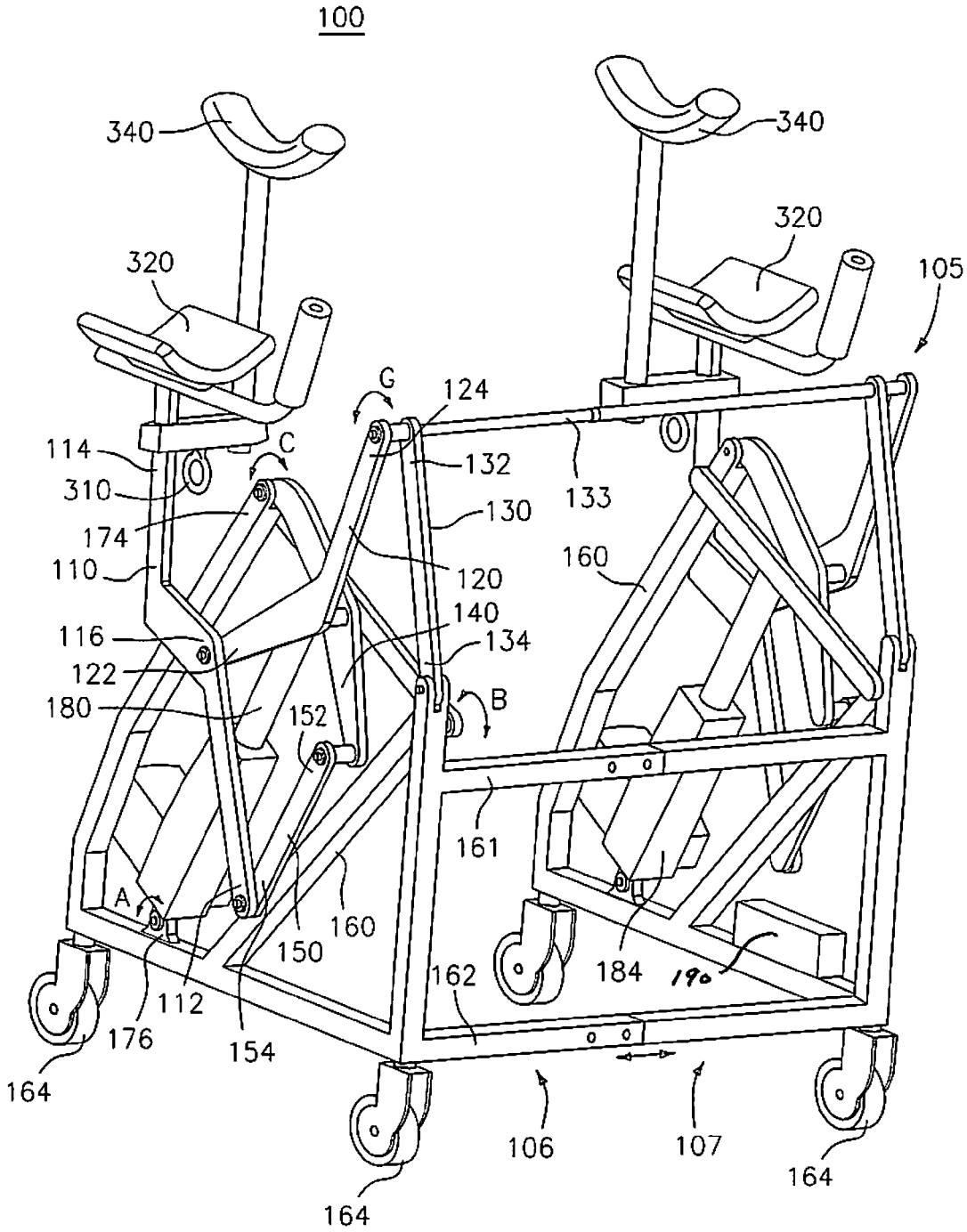
FIG. 2 is a front perspective view of an embodiment of the present invention having a collapsible frame to assist storage.
Figure 6:
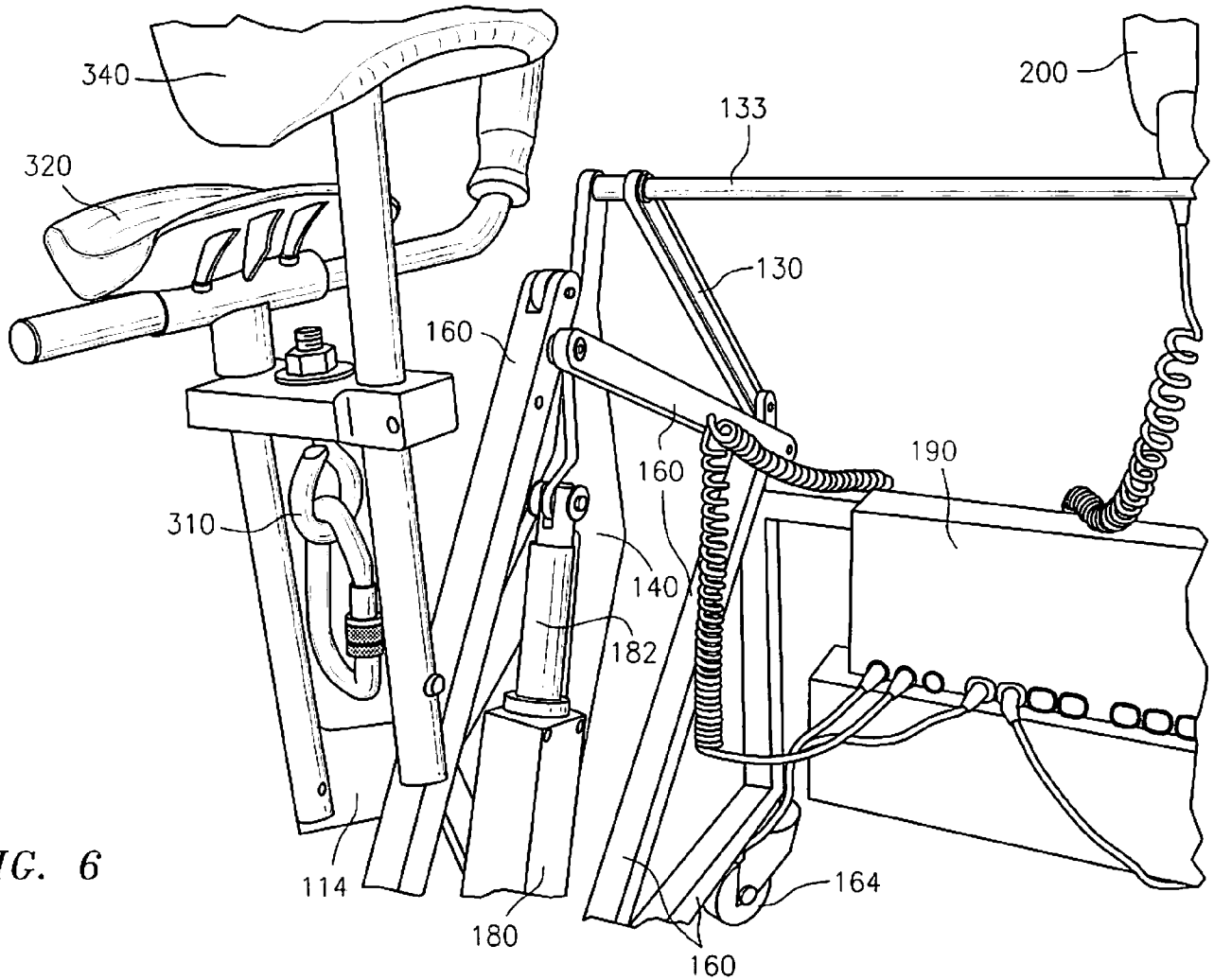
FIG. 6 is a partial rear view of the apparatus of FIG. 1, with the six bar mechanism in the retracted mode.

In a preferred embodiment, an actuator, preferably an electro-mechanical actuator 180, provides a force that changes the relative position of the bars. As shown in FIG. 1, a first end 182 of actuator 180 rotatably connects to a point on second rocker 140. As shown in FIGS. 2, 4 and 6, the first end 182 preferably rotatably connects to a midpoint 146 of the second rocker 140.

Each of the first coupler 120, first rocker 130, second rocker 140, second coupler 150 and actuator 180 have first and second ends, at each of which a rotatable connection is provided about a respective axis. In the preferred embodiment shown in FIG. 1, parallel bar 110 is rotatably attached only at a first end 112 and midpoint 116 thereof, with a second end 114 of parallel bar 110 utilized for lifting of the user, with forearm crutch 320, underarm crutch 340 and securing point 310 provided at second end 114, as show in FIG. 5.

Figure 7:
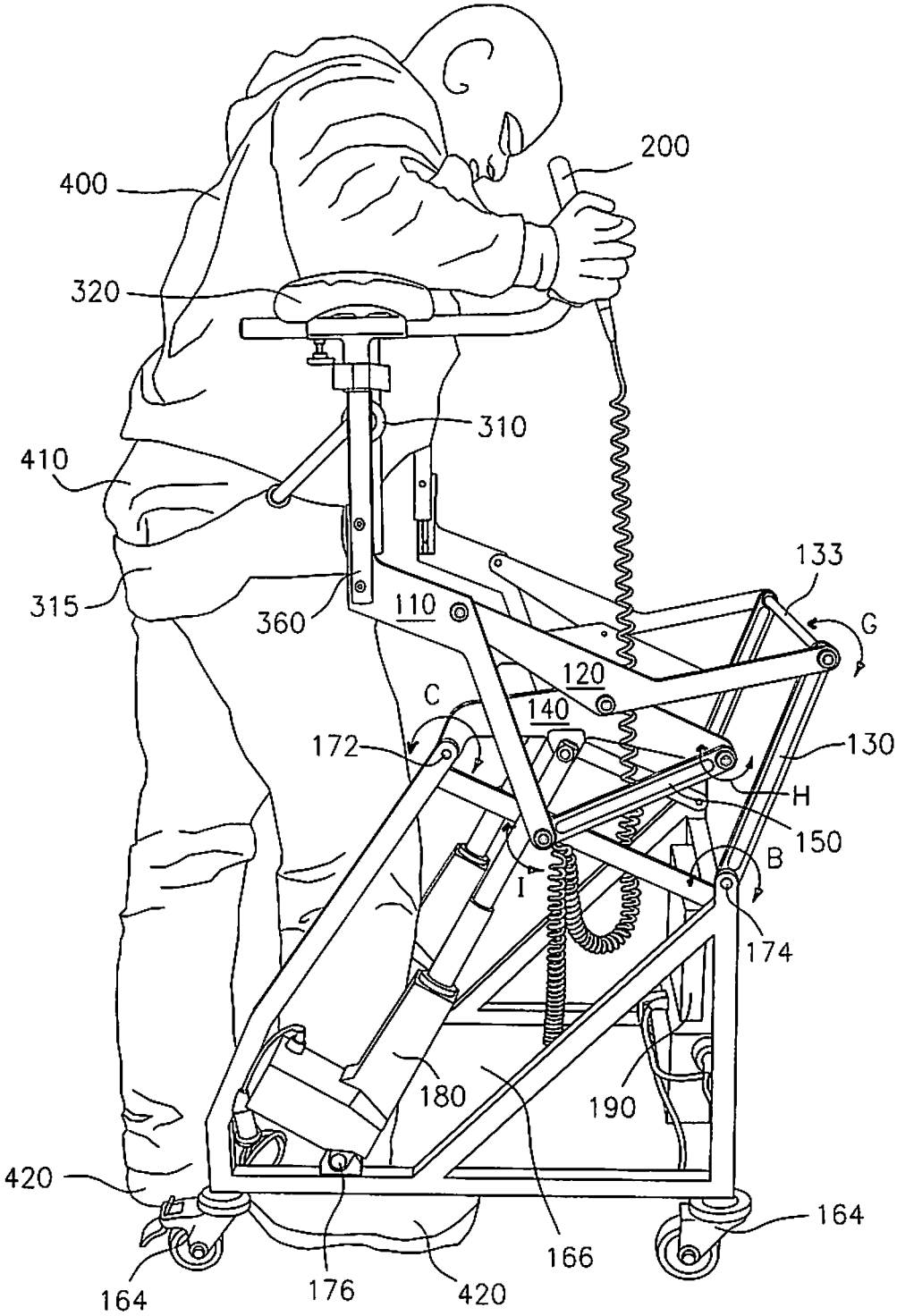
FIG. 7 shows the apparatus of FIG. 1 being utilized as a walker, after a user is lifted to the standing position.

The parallel bar 110 rotatably connects at the first end 112 thereof to a first end 152 of second coupler 150, rotating about axis "I" (See FIGS. 2 and 7). At midpoint 116 of parallel bar 110 a second rotatable connection is provided, rotatably connecting parallel bar 110 about axis "D" to a first end 122 of first coupler 120. It will be recognized by those of skill in the art that the midpoints are not necessarily positioned at a precise middle of the respective bars, rather the midpoint is positioned between the first and second ends of the respective bar.

Figure 3:
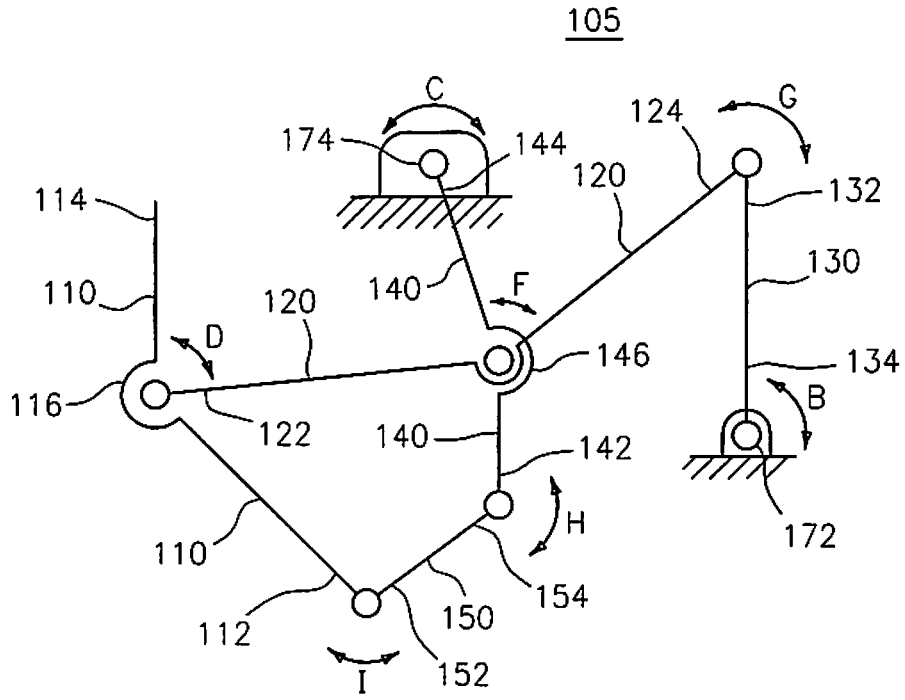
FIG. 3 is a simplified stick diagram of the six bar lifting mechanism of the present invention.

A second end 154 of second coupler 150 rotatably connects to a first end 142 of second rocker 140, rotatably about axis "H" (See FIGS. 1, 3 and 7). A midpoint 146 of second rocker 140 rotatably connects to a midpoint 126 of the first coupler 120, rotatable about axis "F". A second end 144 of second rocker 140 rotatably attaches to frame 160 at a second anchor 174, rotatable about axis "C" (See FIG. 1).

As described above, the first end 122 of first coupler 120 rotatably connects to parallel bar 110 about axis "D". A second end 124 of first coupler 120 rotatably connects to a first end 132 of first rocker 130, about axis "G". A second end 134 of first rocker 130 connects to a first anchor 172, rotatable about axis "B". Accordingly, the parallel bar 110, first rocker 130, second coupler 150 need each only be provided with two rotatable connections. As also described above, each of second rocker 140 and first coupler 120 are provided with three rotatable connections. That is, second rocker 140 includes rotatable connections that rotate about axes "C", "F" and "H", and first coupler 120 includes rotatable connections that rotate about axes "D", "F" and "G", as shown in FIG. 3.

In a preferred embodiment actuator 180 connects at a first end 182 thereof to the midpoint 146 of second rocker 140 (FIG. 1), and connects at a second end 184 thereof to anchor 176, rotatable about axis "A" (FIG. 2). The second end 144 of second rocker 140 connects to the second anchor 174, with each of the anchors 172, 174 and 176 being fixedly positioned on the frame 160. When the above described rotatable interconnection is made of the parallel bar 110, first coupler 120, first rocker 130, second rocker 140, and second coupler 150 to first and second anchor 172 and 174 of frame 160, operation of actuator 180 results in the parallel bar 110 traveling along a J-shaped path (FIG. 8) while maintaining a constant orientation. The J-shaped path replicates a typical path of travel of a user's shoulder joint as the user moves from seated to standing position. The user may also be supported at the hips via a harness 315 (FIG. 7) and/or forearm and underarm crutches 320, 340 (FIGS. 5-7).

Actuator 180 is in a preferred embodiment provided as a linear actuator, such as an electro-mechanical actuator or a pneumatic or hydraulic piston, rotatably coupled at opposite ends to the frame 160 at anchor 176 and to midpoint 146 of second rocker 140. Extension or retraction of the actuator will supply a force acting along a longitudinal direction thereof that moves the interconnected six bars around their respective axes, thereby moving the parallel bar 110 in the J-shaped path. In an alternative embodiment, the relative position of the bars is changed by applying a torque to the second rocker 140, e.g. via a stepper motor. In this alternative embodiment a rotational motor is affixed on frame 160, preferably at second anchor 174, to apply a torque to rotate second rocker 140 about axis "C". In either embodiment, a controller 200 is provided to user 400, as shown in FIG. 7, with up/down buttons to operate the actuators/rotational motor, thereby lifting/lowering the user 400 to the standing/seated position. Limit switches are also preferably provided to indicate fully retracted/extended positions.

In a preferred embodiment, parallel first and second six bar lifting mechanisms (106 and 107 in FIGS. 2 and 5) are provided on opposite sides of frame 160, creating a free space S therebetween, as shown in FIGS. 4, 5, and 7. When the user 400 is supported by the apparatus 100, the user swings his/her foot 420 in an unimpeded fashion through free space S, thereby propelling both the portable lifting apparatus 100 and the user. The user 400 can propel himself or herself and the lifting apparatus without bearing the user's weight on either foot 420, via wheels, e.g. casters 164, positioned on an underside of frame 160. Casters 164 can, in a preferred embodiment, be unidirectional and/or controllable, including braking, by the controller 200, allowing the user 400 to advance in a desired direction.

In a preferred embodiment, the opposite sides of the frame 168, 169 (FIG. 5) have separate actuators 180 for each of the first and second six bar lifting mechanism 106, 107, and a closed loop control is provided to adjust for unbalanced loading conditions by providing greater amperage to a controller upon detection of uneven actuator loading. A rechargeable onboard direct current twenty-four volt battery 190 was found in a prototype to be preferable to power actuator 180. The prototype included two actuators each rated for 2500 N (~560 lbs), which lifted a user weighing up to three hundred pounds at a fully loaded speed of approximately 0.4 inches per second, for a twenty second lifting process.

For storage, the free space S can be reduced or eliminated by pushing opposite sides of frame 160 together, via telescoping frame members 161, 162 (FIG. 2) and a telescoping extension 133 joining each of first ends 132 of first couplers 132.

In another preferred embodiment, the second end 114 of parallel bar 110 is provided with a securing point 310 (FIGS. 2, 4-7). When seated, the user positions harness 315 around his/her upper thighs or buttocks 410, as shown in FIG. 7. The harness 315 is removably secured to the securing point 310 located at the second end 114 of parallel bar 110. Lifting by harness 315 provides a lower metacentric height, thereby improving stability. As shown in FIGS. 2, 4-5 and 7, a forearm crutch 320 with grip and an underarm crutch 340, are also optionally provided to assist or facilitate lifting during the standing/sitting process. Preferably, the weight of user 400 is distributed between harness 315, forearm crutch 320 and underarm crutch 340.

Figure 8A:
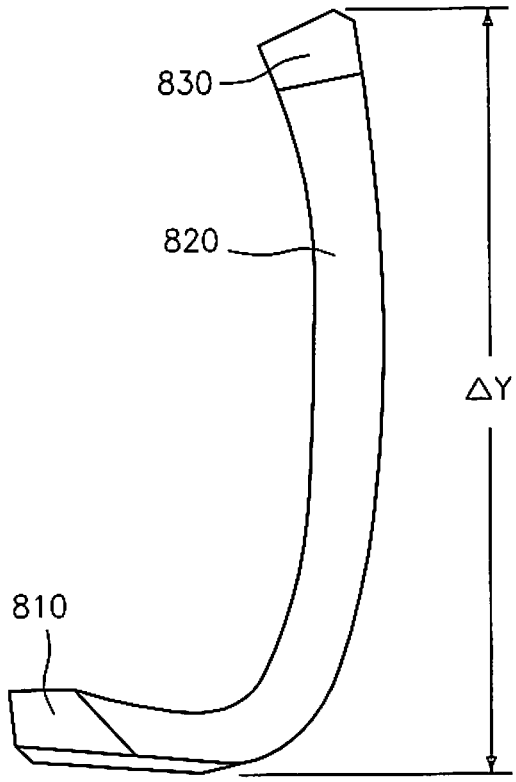
FIGS. 8*a* and 8*b* show travel paths of the user's shoulder and hip, respectively, obtained by utilizing long exposure photography, while moving from a seated to standing position.
Figure 8B:
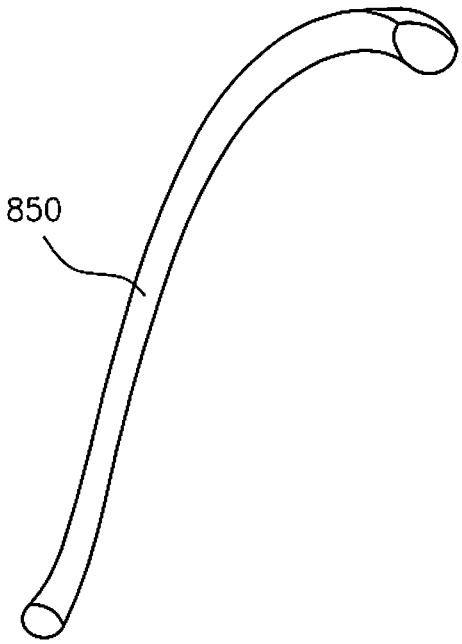

The path through which the user is lifted, i.e. the lift path, follows the natural motion of the J-shaped path, 820 in FIG. 8, followed by a user's shoulder joint that is typically traveled during unassisted standing. The preferred embodiments match a change in height of the user's shoulder joint, i.e. change in vertical distance ($\Delta Y$) between 810 and 830, with the change in vertical height of the six bar mechanism. FIG. 8 also shows a path of hip motion 850 during standing.

The invention is not limited to the disclosed preferred embodiments, and should be construed to cover all such alternatives, modifications and equivalents as defined in the appended claims.

What is claimed is:

1. A portable apparatus for lifting a user, the apparatus comprising:
- an actuator; and
- a lifting mechanism comprising:
  - a parallel bar,
  - a first coupler,
  - a second coupler,
  - a first rocker,
  - a second rocker, and
  - a frame,
- wherein each of the parallel bar, the first coupler, the second coupler, the first rocker, the second rocker, and the frame are rotatably interconnected, and operation of the actuator moves the parallel bar along a J-shaped path.

2. The portable lifting apparatus of claim 1, wherein the actuator is coupled at one end thereof to the frame and at an other end thereof to the second rocker, wherein relative positions of each of the parallel bar, the first coupler, the second coupler, the first rocker, the second rocker, and the frame changes when the actuator provides a force between the frame and the second rocker.

3. The portable lifting apparatus of claim 2, wherein assistance is provided both during a standing process and a sitting process to provide exercise to the user in the standing process and the sitting process.

4. The portable lifting apparatus of claim 3, further comprising a controller accessible to the user to control lifting/lowering between standing/seated positions, to provide varied levels of user exercise.

5. The portable lifting apparatus of claim 4, further comprising:
- a harness for positioning on buttocks of the user and attaching to a securing point fixed to the parallel bar;
- a forearm crutch; and
- an underarm crutch,
- wherein weight of the user is distributed between the harness, the forearm crutch and the underarm crutch during a standing/sitting process.

6. The portable lifting apparatus of claim 1, wherein the actuator provides a force that changes relative positions of each of the parallel bar, the first coupler, the second coupler, the first rocker, the second rocker and the frame.

7. A portable lifting apparatus for lifting a user, the portable lifting apparatus comprising:
- a frame;
- a first lifting mechanism;
- a second lifting mechanism parallel to the first lifting mechanism;
- a free space between the first lifting mechanism and the second lifting mechanism;
- wherein the first lifting mechanism is a six bar lifting mechanism including a parallel bar, a first coupler, a second coupler, a first rocker, a second rocker, and the frame as bars thereof,
- wherein the parallel bar rotatably connects at a first end thereof to a first end of the second coupler,
- wherein the parallel bar rotatably connects to a first end of the first coupler,
- wherein a second end of the second coupler rotatably connects to a first end of the second rocker,
- wherein the second rocker rotatably connects to the first coupler,
- wherein a second end of the second rocker rotatably attaches to the frame at a second anchor,
- wherein a second end of the first coupler rotatably connects to a first end of the first rocker, and
- wherein a second end of the first rocker connects to the frame at a first anchor.

8. The portable lifting apparatus of claim 7, further comprising:
- an actuator affixed to the first lifting mechanism; and
- a controller for operating the actuator to assist the user moving between the seated and standing positions.

9. The portable lifting apparatus of claim 7, further comprising:
- wheels affixed to an underside of the frame,
- wherein the apparatus moves a user between a seated position and a standing position, and
- wherein the user can, by swinging a foot through the free space, propel both the user and the apparatus without bearing the user's entire weight on either foot.

10. The portable lifting apparatus of claim 9, wherein an actuator connects at a first end thereof to the second rocker and connects at a second end thereof to the frame at a third anchor, with each of the first, second and third anchors being fixedly positioned on the frame.

11. The portable lifting apparatus of claim 10, wherein operation of the actuator moves the parallel bar along a J-shaped path.

* * * * *